US006213529B1

(12) United States Patent
Kurcz et al.

(10) Patent No.: US 6,213,529 B1
(45) Date of Patent: Apr. 10, 2001

(54) PROPANE TANK AND ACCESSORY CARRIER

(76) Inventors: Marcia L. Kurcz, 1640 Heather La., Milford, MI (US) 48381; Chris L. Anderson, 3301 Cornell, Dearborn, MI (US) 48124

( * ) Notice: Subject to any disclaimer, the term of this patent is extended or adjusted under 35 U.S.C. 154(b) by 0 days.

(21) Appl. No.: 09/419,503

(22) Filed: Oct. 18, 1999

(51) Int. Cl.[7] ..... B65D 1/24; B65D 85/00

(52) U.S. Cl. ..... 294/143; 206/427; 294/146; 294/159

(58) Field of Search ..... 294/27.1, 31.2, 294/87.2, 87.28, 142–144, 146, 159–163, 165, 169; 206/162, 174, 175, 223, 373, 427

(56) References Cited

U.S. PATENT DOCUMENTS

| | | | | |
|---|---|---|---|---|
| D. 280,258 | | 8/1985 | Miller | D2/400 |
| D. 367,960 | | 3/1996 | Werbesky, Jr. | D3/304 |
| D. 402,466 | | 12/1998 | Werbesky, Jr. | D3/304 |
| 1,260,528 | * | 3/1918 | Evans | 294/143 X |
| 2,645,392 | * | 7/1953 | Gottsegen et al. | 294/143 X |
| 2,896,814 | * | 7/1959 | Altenburg | 294/159 X |
| 3,025,998 | * | 3/1962 | Petersen | 294/146 X |
| 3,565,323 | * | 2/1971 | Kotzenmeyer | 294/159 X |
| 4,475,660 | * | 10/1984 | Cain | 294/143 X |
| 4,735,313 | * | 4/1988 | Schoenberg | 294/159 X |
| 5,335,954 | | 8/1994 | Holub et al. | 294/31.2 |
| 5,702,022 | * | 12/1997 | Umiker | 206/427 X |

* cited by examiner

*Primary Examiner*—Johnny D. Cherry
(74) *Attorney, Agent, or Firm*—Charles W. Chandler

(57) ABSTRACT

A carrier for storing and carrying a pair of cylindrical-shaped canisters.

13 Claims, 3 Drawing Sheets

PROPANE TANK AND ACCESSORY CARRIER

BACKGROUND OF THE INVENTION

This invention is related to a carrier for storing and carrying cylindrically shaped canisters, sometimes known as tanks, for containing compressed oxygen, MAPP gas, propane, acetylene or other portable soldering and heating torch fuels.

To our knowledge, carriers for a pair of propane bottles or canisters, commonly used as torches and normally having a diameter of about 2.875 inches and a height of about 10.25 inches, are not commercially available. Typically, the user will attach a nozzle on top of one canister and use it for heating or other purposes. When the canister is empty, he connects the nozzle on the back-up canister. The problem is that there is no convenient means for carrying the canisters. They will typically roll around in a vehicle, and are difficult to maintain in a stable position when one canister is being used and the other is in a stand-by condition.

When the canisters are carried loosely in a basket, the torch head or canister may be damaged.

The prior art does show some propane tank carriers, see for example: U.S. Design Pat. Nos. 367,960 issued Mar. 19, 1996 for "Safety Propane Tank Carrier"; and No. 402,466 issued Dec. 15, 1998 both to George Werbesky, Jr.; U.S. Design Pat. No. 280,258 issued Aug. 27, 1985, for "Carrier for Gas Torch and Fuel Tank" to Benson L. Miller; U.S. Pat. No. 5,335,954 issued Aug. 9, 1994 for "Propane Bottle Carrier" to Timothy M. Holub, et al. None of these is designed to support a pair of small gas canisters in both a self-supporting upright position, and to be carried by hand.

SUMMARY OF THE INVENTION

The broad purpose of the present invention is to provide an improved carrier for a pair of cylindrical gas canisters having a diameter of about 2.875 inches. In one embodiment of the invention, the carrier is formed from an injection molding process, and in another embodiment, the carrier is formed from a blow-molding process.

Typically, when a canister is being used, a torch head, which may include a self-igniter, is threaded onto the top of the canister and remains in place until the canister is empty. The torch head is then reattached to a full canister.

Our novel design incorporates features permitting sufficient room to carry or secure the canister with or without the torch head. The preferred embodiment includes a pair of pockets for carrying accessories such as spare torch heads, igniter components, solder, flux and related items. The design includes a dual purpose molded in, ergonomically-designed carrying handle which may be used to suspend the carrier for storage, attachment points for securing the carrier to either vertical or horizontal surfaces, and a flat bottom surface for stable upright seating on a horizontal surface.

The one-piece injection molded design uses an extensive grid configuration on the backside to assure carrier strength. The ribs may be formed with either low pressure or high-pressure molding or a gas-assisted molding process. Gas assisted, low pressure molding technology may offer advantages in assuring strength and stiffness, and will also minimize the appearance of knit lines and ribbed read-through on the front surface. The front wall folds, by means of a living hinge design, toward the back wall. In its open position, the carrier can be transported in bulk. When it is to be used, the two halves are folded and snapped together.

A one-piece blow molded embodiment of the invention utilizes a dual wall, single part construction to retain the high rigidity and strength required for use. A dual wall on the lower half of the front of the design becomes the outer wall, which secures the tanks in a position within the carrier. The same wall also forms two pockets, one on each side of the carrier for containing accessories. Blow molding stiffening features known as tack-offs, add strength to the back wall, around the carrying handle and the hanger opening for mounting the carrier. The carrying handle is molded with additional tack-offs incorporated at the top area for rigidity. The handle opening and accessory pockets are achieved through trimming the material in the center section. The carrier base is molded as a flat section to assure stability when the carrier is resting on or attached to a horizontal surface.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
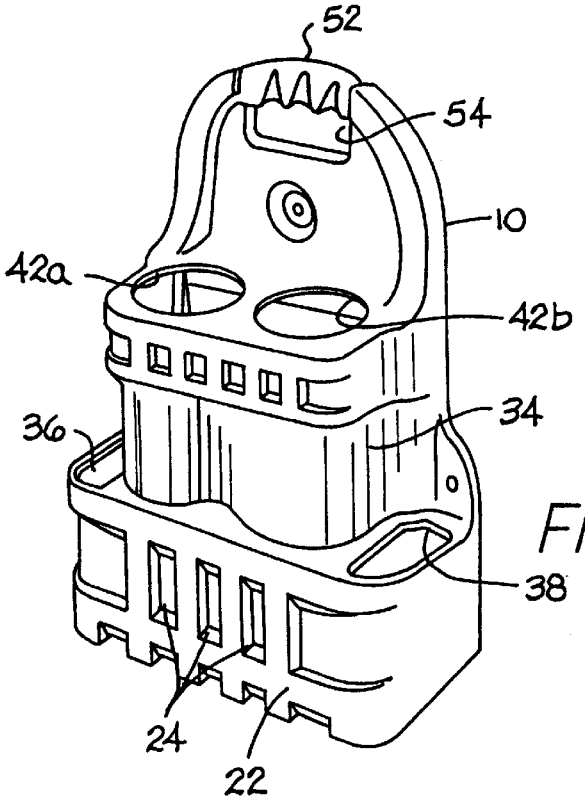
FIG. 1 is a perspective view of a canister carrier illustrating the preferred embodiment of the invention.
Figure 2:
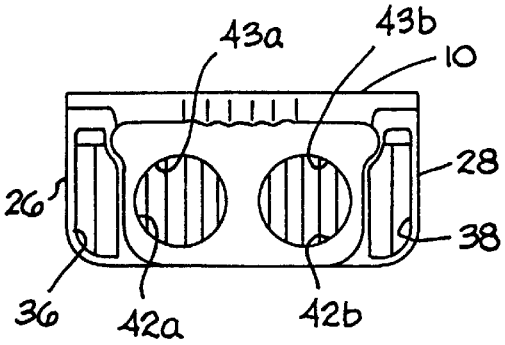
FIG. 2 is a plan view of the carrier of FIG. 1.
Figure 5:
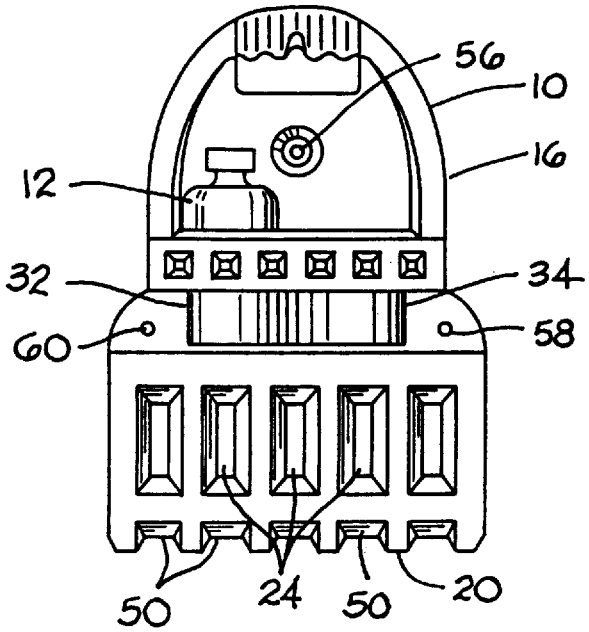
FIG. 5 is a front view of the preferred embodiment, showing the location of a canister.

Referring to the drawings, FIGS. 1 and 5 illustrate a preferred carrier 10 for carrying a pair of gas canisters 12, only one shown. The canisters are conventional and generally designed with a cylindrical housing up to 2.875 inches in diameter and from 10.25 inches in height, without a torch head. The carrier is also illustrated for carrying other various torch accessories, such as an igniter, not shown.

Figure 3:
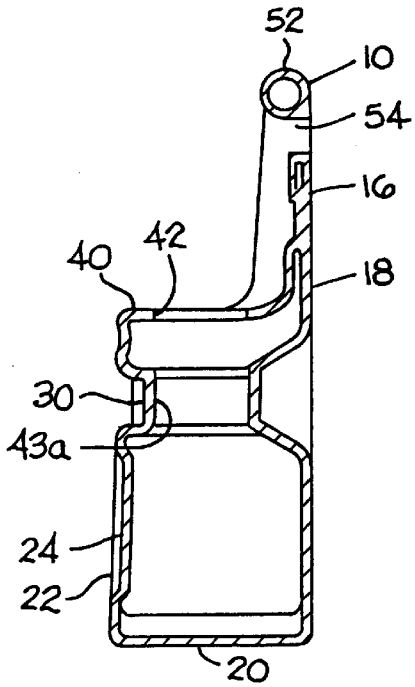
FIG. 3 is a vertical sectional view of the embodiment of FIG. 1.

Carrier 10 includes a hollow body 16 formed of a suitable plastic. Referring to FIG. 3, body 16 has a generally planar back wall 18, and a bottom wall 20 connected to the lower edge of the back wall. The back wall is intended to be disposed against a vertical surface when the carrier is to be hung in position, while bottom wall 20 is intended to be disposed in a horizontal position when the canister is to be supported in a stable upright position.

Still referring to FIG. 3, the body includes a lower front wall 22 having recessed stiffening ribs 24. The lower front wall extends about one third of the height of the carrier and is connected to a pair of sidewalls 26 and 28. Front wall 22 is parallel to back wall 18, and perpendicular to sidewalls 26 and 28.

The body has a neck 30 and a pair of recessed sidewalls 32 and 34 with a pair of open top accessory pockets 36 and 38.

The body has an upper horizontal wall 40 which is parallel to bottom wall 20 and a pair of access openings 42*a* and 42*b* for receiving a pair of gas canisters in a side-by-side, spaced relationship. The bottoms of the canisters are seated on bottom wall 20. Neck 30 has internal structure with a pair of cylindrical opening 43, each with a diameter of up to about 2.875 inches slidably engaging the sidewalls of the canisters.

Opening 43 is aligned directly below the edges of access openings 42*a* and 42*b*. Openings 43 and 43*b* retain the canisters in either an upright position when the bottom back wall of the body is disposed on a horizontal surface, or in a horizontal position when the back wall is disposed on a horizontal surface. The edges of openings 42*a* and 42*b* cooperate with openings 43*a* and 43*b* to retain the canisters in a controlled position so that they are not loose when the user is moving them from one location to another.

The bottom wall has a series of recessed parallel channels 50 that provide a ribbed reinforcement, as can best be seen in FIG. 5.

Figure 4:
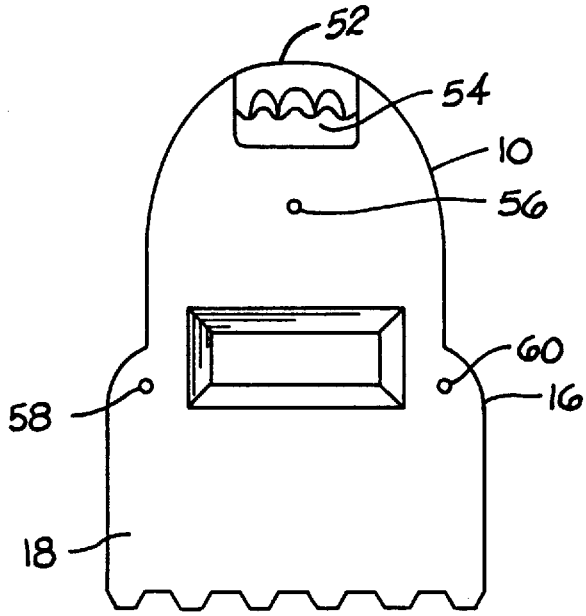
FIG. 4 is a rear view of the embodiment of FIG. 1.

Referring to FIG. 4, back wall 18 has an upper edge 52 that is about one third of the distance above upper wall 40 through which the canisters are inserted. The back wall has an opening 54 providing a handgrip for the user to carry the carrier.

The back wall also has fastener-receiving openings 56, 58 and 60 for fastening the carrier to a vertical wall.

Thus, we have described a carrier for carrying either one or two gas canisters in the body, and related torch accessories in side pockets 36 and 38.

Figure 6:
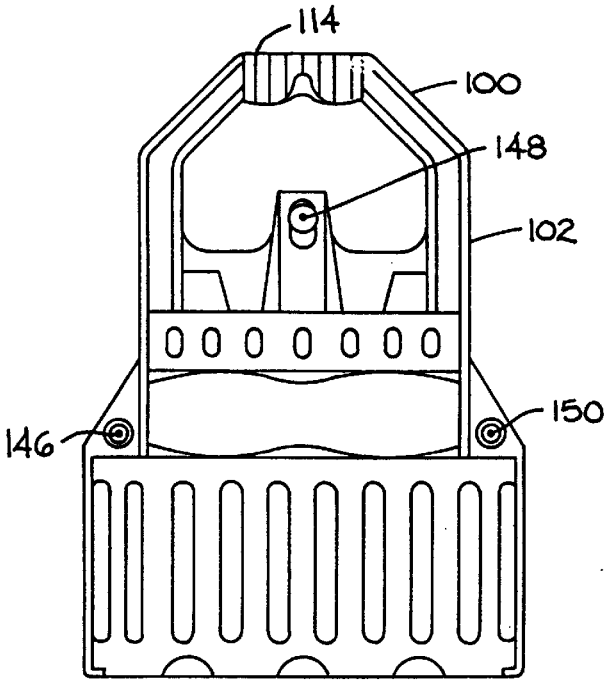
FIG. 6 is a front view of another embodiment of the invention made by an injection-molded process.
Figure 7:
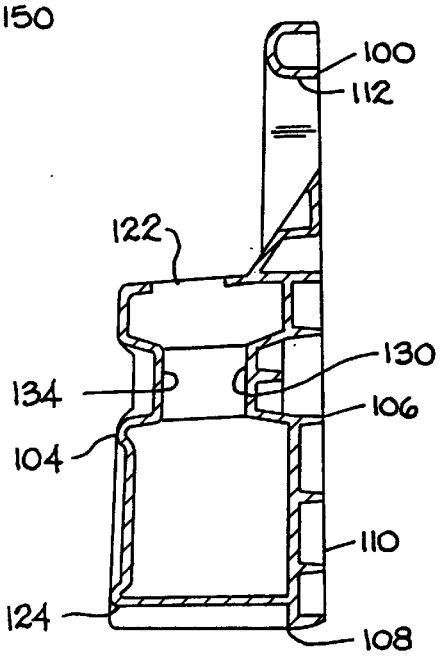
FIG. 7 is a sectional view of the embodiment of FIG. 6.
Figure 8:
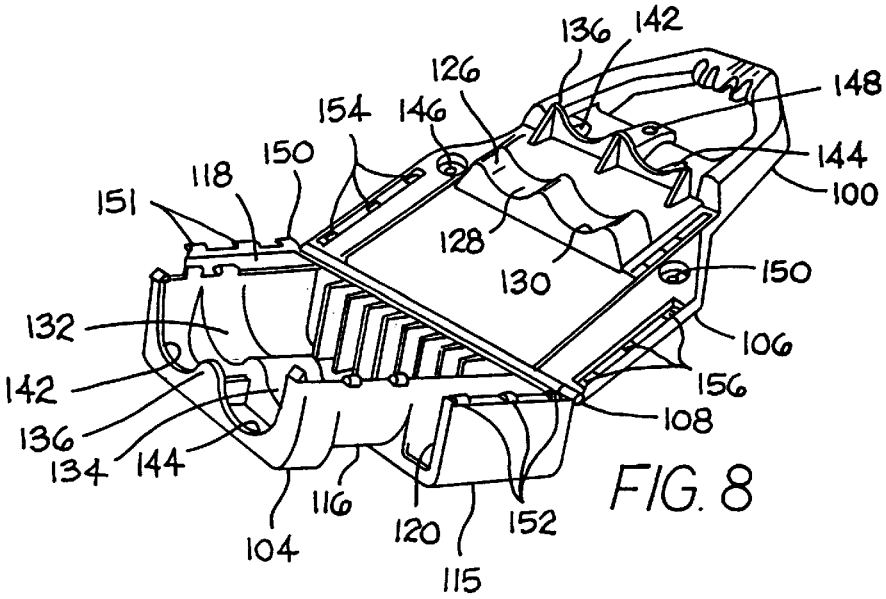
FIG. 8 is a perspective view of the embodiment of FIG. 6 in its open condition before being assembled for use.

FIGS. 6–8 illustrate an injection-molded version 100 of our invention, which in general has a configuration similar to the embodiment of FIG. 1. However, in this case, body 102 is formed in two halves 104 and 106 joined along a living hinge 108 attached to the lower edge of rear wall 110. Rear wall 110 is generally planar so that the carrier can be mounted against a vertical wall. The rear wall also has an opening 112 defining a handle 114 for carrying the carrier.

Body 102 has a lower front wall 115 that merges with upper front wall 116 having side accessory openings 118 and 120.

A pair of canisters, not shown, is inserted through top access opening 122 for receiving the canisters into the body. The canisters are then seated on bottom wall 124 in a side-by-side parallel relationship.

The back wall has an internal structure 126 with a pair of semi-cylindrical surfaces 128 and 130, that abut the backside of the canisters. The front wall has a pair of semi-cylindrical retaining surfaces 132 and 134, that abut the front side of the retaining canisters and are opposed to surfaces 128 and 130. A top wall 136 has a pair of canister receiving openings 142 and 144 formed when the two body halves are face-to-face, having internal cylindrical surfaces for retaining the canisters in position.

The back wall also has three fastener-receiving openings 146, 148, and 150 for mounting the back wall of the carrier on a vertical wall.

In the position illustrated in FIG. 8, the two halves 104 and 106 of the body are open and adapted to be disposed in a relatively flat position for shipping purposes. The front wall has a series of snap fingers 151 along one edge of the side wall, and a plurality of snap fingers 152 along the opposite side edge which are received into snap finger opening means 154 and 156 along opposite sides of the rear wall to firmly assemble the front wall to the rear wall. In the body's open position, the accessory pockets are open; however, when the two halves of the body are closed, the pockets are completed to form the accessory pockets.

Having described our invention, we claim:

1. A carrier for at least a pair of cylindrical gas canisters, each canister having a base, a top and a longitudinal axis, said carrier comprising:

a hollow body having a rigid back wall having a peripheral edge means, and a top handle opening adjacent said peripheral edge means;

a rigid front unitary shell having edge means, a top wall and a bottom wall, the top wall having a canister-receiving opening spaced from the bottom wall a distance less than the length of the canister between the canister top and the canister base whereby when the canister base is disposed on the bottom wall of the shell, the top of the canister is disposed above the top wall of the shell;

means for connecting the rigid back wall to the shell to form said hollow body; and a first curvilinear partially cylindrical structure in said shell for engaging a first side of a pair of canisters, and a second curvilinear partially cylindrical structure to cooperate therewith for retaining the canisters between said partially cylindrical structures in a position in which the longitudinal axis of each of the canisters is parallel to the back wall and perpendicular to the bottom wall of the shell.

2. A carrier as defined in claim 1, in which the body is a one-piece item formed by an injection process.

3. A carrier as defined in claim 1, in which the shell has a second opening in the top wall spaced above the bottom wall cooperating with the back wall to form an accessory-opening adjacent a retained position of a canister.

4. A carrier for at least one cylindrical gas canister, comprising:

a hollow body having:

a rigid back wall having an upper edge and a lower edge;

a bottom wall generally perpendicular to the back wall and connected thereto, the bottom wall being disposable on a horizontal surface in a stored position in which the back wall is in a vertical position;

an upper wall generally parallel to the bottom wall, the upper wall having a top opening for receiving an elongated cylindrical gas canister having a base, a top, and a length greater than the distance between said bottom wall and said upper wall, such that when the base of the canister is disposed in a stored position on said bottom wall, the top of the canister is disposed above the upper wall;

said back wall having a handle opening above the upper wall;

the top opening having an edge having a diameter sized to receive at least a portion of the canister to retain it in said stored position parallel to the back wall when the body is placed on a supporting surface; and the body being a two-piece item formed by a molding process.

5. A carrier as defined in claim 4, in which the back wall has an opening for receiving a fastener for suspending the body on a vertical wall.

6. A carrier as defined in claim 4, in which the upper wall has a pair of side-by-side top openings for receiving a pair of spaced parallel canisters.

7. A carrier for at least one cylindrical gas canister, comprising:

a hollow body having:

a rigid back wall having an upper edge and a lower edge;

a bottom wall generally perpendicular to the back wall and connected thereto, the bottom wall being disposable on a horizontal surface in a stored position in which the back wall is in a vertical position;

an upper wall generally parallel to the bottom wall, the upper wall having a top opening for receiving an elongated cylindrical gas canister having a base, a top, and a length greater than the distance between said bottom wall and said upper wall, such that when the base of the canister is disposed in a stored position on said bottom wall, the top of the canister is disposed above the upper wall;

said back wall having a handle opening above the upper wall;

the top opening having an edge having a diameter sized to receive at least a portion of the canister to retain it in said stored position parallel to the back wall when the body is placed on a supporting surface; and the body being formed of two components including a back wall having a living hinge at the bottom edge thereof, and a front wall connected by the living hinge to the back wall.

8. A carrier for at least one cylindrical gas canister, comprising:

a hollow body having:

a rigid back wall having an upper edge and a lower edge;

a bottom wall generally perpendicular to the back wall and connected thereto, the bottom wall being disposable on a horizontal surface in a stored position which the back wall is in a vertical position;

an upper wall generally parallel to the bottom wall, the upper wall having a top opening for receiving an elongated cylindrical gas canister having a base, a top, and a length greater than the distance between said bottom wall and said upper wall, such that when the base of the canister is disposed in a stored position on said bottom wall, the top of the canister is disposed above the upper wall;

said back wall having a handle opening above the upper wall;

the top opening having an edge having a diameter sized to receive at least a portion of the canister to retain it in said stored position parallel to the back wall when the body is placed on a supporting surface; and a first neck means having an internal partially cylindrical wall mounted on the back wall for engaging a first side of a canister and a second complementary internal neck means having a partially cylindrical wall for engaging the opposite side of the canister, the first and second neck means being disposed between the upper wall and the bottom wall.

9. A carrier as defined in claim 8, in which the first and second neck means are spaced from the bottom wall.

10. A carrier as defined in claim 8, in which the neck means have a generally figure eight opening for receiving a pair of spaced canisters.

11. A carrier as defined in claim 10, in which the figure eight opening has a diameter no greater than 3 inches for receiving a canister.

12. A carrier as defined in claim 8, including a front wall integrally attached to said body and forming an accessory pocket having a top opening, adjacent the stored position of the canister.

13. A carrier as defined in claim 12, in which the back wall is connected to said front wall by hinged means in such a manner that as the back wall is pivoted toward a closed position with the front wall, an accessory pocket is assembled into a closed position.

* * * * *